United States Patent [19]

Davis

[11] 4,449,857

[45] May 22, 1984

[54] RETAINED EARTH SYSTEM WITH THREADED CONNECTION BETWEEN A RETAINING WALL AND SOIL REINFORCEMENT PANELS

[75] Inventor: Edgar A. Davis, San Jose, Calif.

[73] Assignee: VSL Corporation, Los Gatos, Calif.

[21] Appl. No.: 314,699

[22] Filed: Oct. 26, 1981

[51] Int. Cl.[3] ..... E02D 29/02

[52] U.S. Cl. ..... 405/286; 403/308; 52/166

[58] Field of Search ..... 405/284, 286, 287, 15; 403/308; 52/166

[56] References Cited

U.S. PATENT DOCUMENTS

| | | | |
|---|---|---|---|
| Re. 28,977 | 9/1976 | Mason | 405/287 X |
| 569,995 | 10/1896 | Boyd | 403/308 |
| 1,772,174 | 8/1930 | Anderson | 403/308 |
| 2,902,743 | 9/1959 | King | 405/284 X |
| 4,045,965 | 9/1977 | Vidal | 405/287 |
| 4,189,891 | 2/1980 | Johnson | 405/284 X |
| 4,260,296 | 4/1981 | Hilfiker | 405/284 |
| 4,303,355 | 12/1981 | Vilcinskas | 405/284 X |
| 4,329,089 | 5/1982 | Hilfiker | 405/262 |

*Primary Examiner*—Ernest R. Purser
*Assistant Examiner*—Beverly E. Hjorth
*Attorney, Agent, or Firm*—Flehr, Hohbach, Test, Albritton, & Herbert

[57] ABSTRACT

A soil retaining system, including an upright soil retaining wall of modular facing panels and a number of horizontal wire mesh reinforcement units, including spaced parallel wires ending in bulbous portions and interconnected by perpendicular crossbars. The mesh units are connected in tiers to the retaining wall and rest in the soil behind the wall. The connection is made by a female member embedded into the back side of the panel with internal threads, into which a male member is threadedly received with an internal bore of a suitable size to pass the wires but not the bulbous portions which bear against the forward end of the bolts. In this manner, with the wires seated within a corresponding male member, the facing panels and mesh units are connected by screwing the male member into the female member.

5 Claims, 5 Drawing Figures

RETAINED EARTH SYSTEM WITH THREADED CONNECTION BETWEEN A RETAINING WALL AND SOIL REINFORCEMENT PANELS

Reference is made to Drew U.S. application Ser. No. 144,731, filed Jan. 24, 1980, now abandoned; Drew U.S. application Ser. No. 127,550, filed Mar. 6, 1980, now abandoned; and Drew et al U.S. application Ser. No. 127,784, filed Mar. 6, 1980, now abandoned.

Soil reinforcement systems have been utilized in which a retaining wall is connected to tiered tensile soil reinforcement elements. These soil reinforcement elements are steel strips which penetrate the soil and serve to reinforce the soil by soil to strip frictional contact. The system utilized in this application is a welded wire mesh which resists soil stresses through soil bearing on cross bars of the mat, which then transfer this stress in shear to the welded tension wires. These wires provide tensile strength to the retained soil mass. The use of the welded wire mesh soil reinforcement differs from earlier systems in that it is not dependent on soil to tensile element friction. This welded wire mesh system has been employed in the past by the California Department of Transportation. An analysis of the advantages of this system is set forth in Forsyth, Raymond A., "Alternative Earth Reinforcements", proceedings from the ASCE symposium on Earth Reinforcements, Pittsburgh, PA, 1978, pp. 350–370.

In the last named system, special bolts are used to connect the soil reinforcing mesh panels to the wall facing panels. These bolts are sunk through the front side of the wall facing panels and extend through the rear of the same and are hand welded to flat bars which, in turn, provide connections for the wire mesh mats. While this system provides an adequate connection, it is relatively expensive in both material and labor to perform the hand welding operation.

Each of the above-identified patent applications provide modes of connecting wire mesh soil reinforcement panels to modular facing panels of an upright soil retaining wall, which modes are less expensive and less time consuming than conventional ones.

It is an object of the present invention to provide an improved connection system.

It is a particular object of the invention to provide such a system utilizing a threaded attachment which is readily performed in the field and which is highly durable during long-term use.

Further objects and features of the invention will be apparent from the following description taken in conjunction with the appendant drawings.

In accordance with the foregoing objects, a connection system is provided for interconnecting an upright soil retaining wall formed of modular facing panels with a number of soil reinforcement panels formed of parallel wires, terminating in enlarged bulbous portions at one end, which wires are mounted to spaced crossbars. One portion of the assembly comprises cylindrical internally threaded female members anchored into the back side of the facing panels. Cylindrical externally threaded interconnecting male members mate with the female members. Each of the male members define an axially aligned central base to receive the wire and retain it at its bulbous portion. Each male member is screwed into the female member to fixedly secure the wire to the facing panel.

Figure 1:
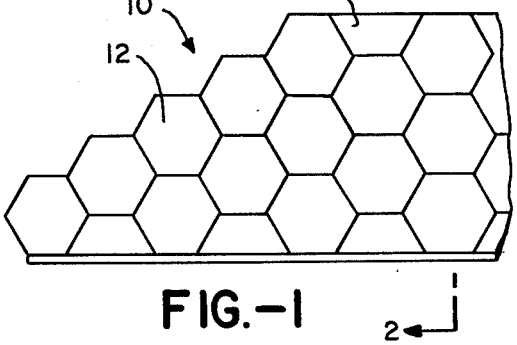
FIG. 1 is an elevation of a number of modular facing panels arranged in a retaining wall.
Figure 2:
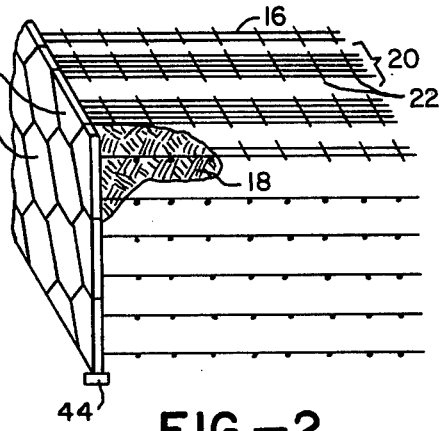
FIG. 2 is a schematic cross-sectional view of the retaining wall of FIG. 1 illustrating connected mesh reinforcement panels embedded in soil.

Referring to FIGS. 1 and 2, a retained earth retaining wall system is illustrated in accordance with the present invention. It includes an upright, typically vertical, retaining wall, generally designated by the number 10, formed of interlinked modular facing full panels 12 and half facing panels 14 to be described more fully below. Extending from the backside of panels 12 and 14 in a generally horizontal direction are wire mesh soil reinforcement panels 16, embedded into the soil, generally designated by the number 18. A mesh reinforcement panel includes a plurality, generally four to eight, of generally parallel spaced metal wires 20 interconnected by parallel spaced crossbars 22, preferably by welding at cross-over points. Crossbars 22 are generally perpendicular to wires 20. Wires 20 terminate in enlarged bulbous portions **20*a*, known as button heads. As illustrated, such portions constitute a hemisphere with a flat backing. They are commonly formed by a hydraulic ram with a die forming head. However, it should be understood that the system is applicable to any enlarged section of wire 20** at its extremity.

As set out below, the soil reinforcement panels are attached to the soil retaining wall facing panels in spaced horizontal layers from the bottom to the top, with soil being layered above the lowermost one up to a level at which the next unit in order is attached to the retaining wall. In this manner, the mesh reinforcement panels are embedded into the soil.

The nature of this system is such that soil reinforcement panels 16 accept soil pressure against crossbars 22 in bearing (i.e., soil against bar). This bearing pressure is transferred to the lateral parallel wires 20. This system is an improvement over the use of strips in that strips require the development of tensile strength through frictional contact with the soil which, in turn, requires that strict limits be maintained on the embankment soil and its placement in the soil mass.

Any number of different spacing of wires 20 and crossbars 22 may be employed in accordance with known practice. One suitable type of unit includes $\frac{3}{8}$ in. diameter wires 20 and crossbars 22 forming a grid typically with 6 inches between wires and 24 inches between crossbars. The welds between the wires and crossbars should be sufficient to develop the full yield strength of the longitudinal wires and to develop a shear strength equal to or greater than 50% of the longitudinal wire yield strength.

Figure 3:
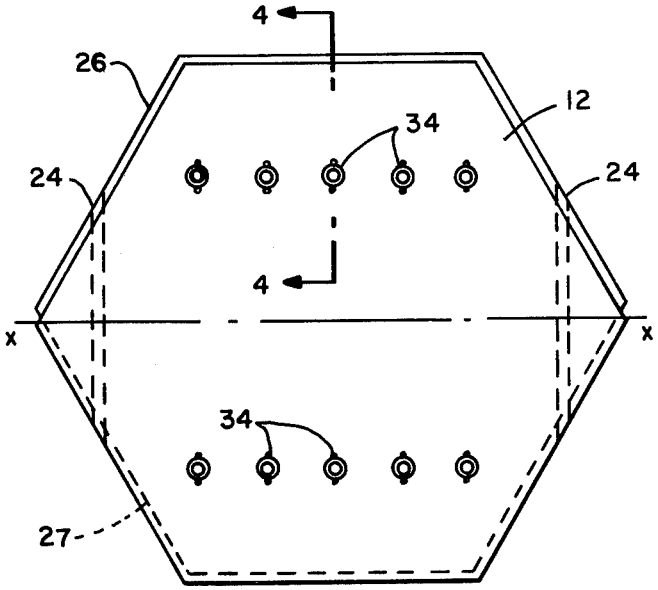
FIG. 3 is a rear elevation of a modular facing panel illustrating embedded female members for connection.

Referring to FIGS. 2 and 3, a suitable modular facing panel 12 is illustrated. It is hexagonal in shape and is suitably formed by casting concrete into the desired shape. Each unit includes holes 24 for vertical linking pins (not shown) which project through adjacent panels to interlock the facing panels together into retaining wall 10. In addition, tongues 26 are provided at the edges of the panels for mating with corresponding grooves 27 in adjacent panels for alignment and stability.

A suitable panel measures 4 feet between facing end walls. However, larger panels may prove more suitable for larger wall projects.

To provide a level wall, half-panels 14 are interlinked alternately at the top and bottom of the wall as illustrated in FIG. 1. Referring to FIG. 3, such a half-panel is suitably formed from a full panel cut in half along the line X—X. Other panel configurations will be necessary to interlock with full and half panels when the upper edge of the wall is required to be sloped instead of flat relative to a horizontal line. Alternately, panel segments may be case individually.

Figure 4:
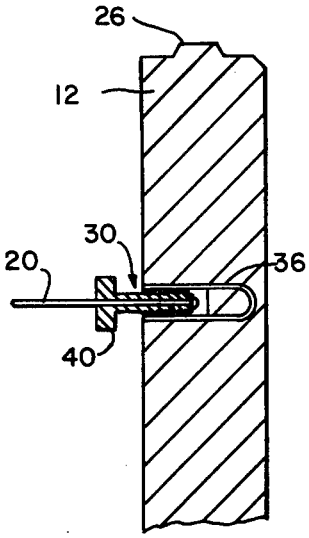
FIG. 4 is an enlarged side cross-sectional view of a portion of the modular facing panel and a connecting member of FIG. 3, taken along the line 4—4.
Figure 5:
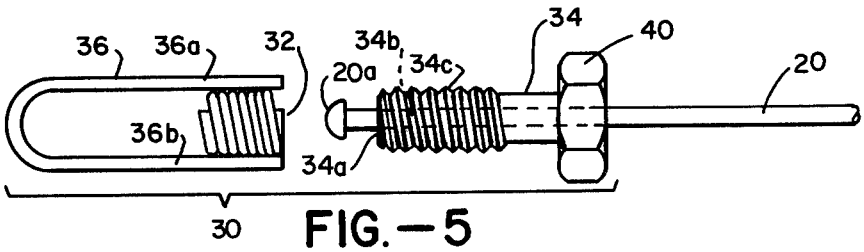
FIG. 5 is an exploded view illustrating the female portion of the connecting assembly removed from the facing panel, and its relationship to the male connecting member and wire.

A main feature of the present invention is the provision of a convenient mode of connecting retaining wall facing panels 12, half-panels 14 and other applicable panel configurations to soil reinforcement panels 16. Referring to FIGS. 4 and 5, an assembly generally designated by the number 30 is utilized to provide such a connection. Such assembly comprises an internal threaded cylindrical female member 32, and an externally threaded, interconnecting cylindrical male member 34 adapted to be threadedly received by the female member. As discussed below, wire 20 is received in a bore within male member 34 so that the bulbous portion bears against one surface. Male member 34 is threadedly received within female member 32.

Female member 32 can be formed of any cylindrical body with internal threads. In the illustrated embodiment, it is formed of a tightly wrapped metal coil, the interior of which threadedly engages with the exterior threads of male member 34. Anchoring means is preferably provided to the panel interior of female member 32. As illustrated, such anchoring means comprises an elongate U-shaped member 36, which resists tension forces pulling the mesh panels away from the facing panel, as set out below. The free arms 36*a* and 36*b* of member 36 are welded to the exterior of female member 32, while the connecting base of the U-shaped member projects inwardly into the panel. In a preferred embodiment, U-shaped member 36 and female member 34 are cast in place within the concrete facing panel as illustrated in FIG. 4. The outward end of female member 32 is flush with the soil side of the facing panel. If desired, space may be provided behind the inward end of female member 32 within the panel for screwing the male member beyond that inward end if desired. As illustrated in FIG. 4, female member 32 is preferably disposed perpendicular to the main plane of the facing panel.

Male member 34 is of generally cylindrical configuration, and generally resembles a bolt. In that regard, it preferably includes at one end a multi-faced head 40, suitable for convenient rotation with a wrench. The interior or forward end of male member 34 terminates in a squared wall 34*a* perpendicular to the member axis. Male member 34 defines an interior cylindrical bore 34*b* axially aligned with the main body of the male member and of a diameter slightly larger than the diameter of one of wires 20, but smaller than bulbous portion 20*a*. Exterior of the forward portion of male member 34 are threads 34*c* which threadedly mate with the interior threading of female member 32. Referring to FIG. 3, a number of female members 34, five in a line as illustrated, are disposed in tandem spaced, generally horizontal row.

The individual connections are made as illustrated in FIG. 5. First, male members 34 with the heads 40 facing the mesh panels are slid over the wires so that the wires pass through the bores. Then the bulbous portions 20*a* are formed as set forth above at the wall 34*a* side. Then, the mesh panels are disposed adjacent the facing panels, with bulbous portions 20*a* of wires 20 adjacent to female members 32. Thereafter, male member 34 with the internal wire is screwed into female member 32, to the desired depth for secure connection. This is readily performed by use of a wrench secured to head 40. It is apparent that the mesh panels are incapable of rotation during this operation; and so, male member 34 must be freely rotatable with respect to wire 20 for threading reception of the male member 34 into female member 32. The bulbous portions 20*a* bear around their entire back side against male member wall 34 to make a strong connection.

One suitable procedure for forming the overall soil retaining system of the present invention is as follows. The soil is first leveled at the desired depth. Then, a leveling pad 44 (typically formed of concrete 1 ft. wide×0.5 ft. deep) is placed on the soil. A bottom layer of upright, alternating full and half-facing panels illustrated in FIG. 1, is then placed on the levelling pad. These panels are supported and held vertically by temporary braces on the front or finished side of the wall. Pins are placed in holes 24 interlocking adjacent panels to provide additional support. The panels are disposed in the manner illustrated in FIGS. 3 and 4, so that the interior of female members 32 are open to the soil in spaced horizontal relationship. The soil is then backfilled up to the lowermost female member 32 of the bottom full panels (or the only female members of the bottom half panels). The wires of a first panel 16 are slid into male members 34 and the bulbous portions are formed. The wires of panels 16 with male members 34 attached are then screwed into female members 32 as set out above.

Preferably, there is a two to one relationship between rows of female members and facing panels so that each full facing panel has two mesh reinforcement panels attached to its back face. However, if desired, a less or greater number of reinforcing panels may also be employed.

In the next step, soil is placed above the first tier of soil reinforcing panels to a level at which a second tier of reinforcing panels may be conveniently laid to rest in the slots of the upper female members of the lowermost full panels.

In the next step, another series of panels is interlinked with the base series of facing panels by conventional means. In the illustrated embodiment, pins are placed in holes 24 to provide additional alignment capabilities. In addition, the grooves of mating units interlink with each other. Other techniques may be employed for reinforcing the modular units as is conventional in the retaining wall and precast concrete fields. The above steps are repeated with respect to connecting soil reinforcement panel 16 in a tiered horizontally spaced series as illustrated in FIG. 2 until the desired height of the retaining wall is achieved. In the top layer half-panels are alternately positioned as illustrated in FIG. 1. The soil is conventionally compacted in horizontal layers approximately ⅝ foot in height as the wall is erected.

As set out above, a soil retaining system with the foregoing welded wire soil reinforcement mesh panels 16 resists soil stress through soil bearing on the crossbars which then transfer this stress in shear to the welded tension wires. The circular section of the wires provides the optimum end-to-surface area ratio for corrosion resistance. Overall, this is a highly effective reinforced earth retaining wall system with a particularly simplified method of attachment of the reinforcement panels to the retaining wall.

A number of modifications of the present system may be made without departing from the scope of the invention. For example, while the modular units are illustrated in a hexagonal configuration, it should be understood that other modular units may also be employed, say of a star-shaped or rectangular configuration, without departing from the scope of the invention. Furthermore, the number, spacing and material of the mesh reinforcement panels may be modified depending upon the characteristics desired for the overall system. This would result in corresponding modification of the connecting units.

The assembly of male and female members may also be modified in form. The main prerequisite is that the female and male members have a threading connection and that the male member include a bore for the wires and a squared forward wall for the bulbous portions to seat or bear against.

It is apparent from the foregoing that a unique connecting system has been provided for the interconnecting of modular soil retaining walls with wire mesh reinforcement panels which have the unique advantages of significantly reducing the labor required in the field compared to conventional techniques and which, thus, significantly reduces the costs of the system.

What is claimed is:

1. A soil retaining system comprising (a) an upright soil retaining wall comprising interlinked modular facing panels, (b) a plurality of soil reinforcement panels, each comprising a plurality of spaced generally parallel wires and spaced crossbars rigidly mounted at crossover points of said parallel wires in generally perpendicular relationship, one end of said parallel wires terminating in enlarged bulbous portions, (c) a plurality of cylindrical internally threaded female members anchored in the back sides of said facing panels, said female members forming at least one tandem, spaced, generally horizontal row, (d) a plurality of cylindrical externally threaded interconnecting male members mating with said female members and disposed therein, each of said male members having a forward end wall directed toward said retaining wall, each of said male members defining an axially aligned bore of a width larger than the diameter of one of said wires, but smaller than the bulbous portions, whereby said wire is rotatable with respect to said bore when seated therein, said bores being spaced to register with the parallel wires of said mesh panels, and (e) the wires of one of said mesh panels being disposed in said bores with the bulbous portions seated to bear against said forward end walls of said male members to interconnect corresponding facing panels and mesh panels.

2. The soil retaining system of claim 1 in which said male and female members and wire mesh panels form spaced parallel generally horizontal tiers with soil disposed therebetween.

3. The soil retaining system of claim 1 in which said female members are anchored into the back side of a facing panel in rows and mesh panels are connected to the rows.

4. The soil retaining system of claim 3 together with anchoring means for said female members in the form of U-shaped members embedded in corresponding panels, the free arms of the U-shaped member being mounted to a corresponding female member and projecting into said panels.

5. The soil retaining system in claim 1 in which said female member is in the form of a rigid coil.

* * * * *